US008556411B2

(12) United States Patent
Niu

(10) Patent No.: US 8,556,411 B2
(45) Date of Patent: Oct. 15, 2013

(54) INKJET PRINTABLE ARTICLE AND METHOD OF MAKING THE SAME

(75) Inventor: Bor-Jiunn Niu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 411 days.

(21) Appl. No.: 12/933,081

(22) PCT Filed: Apr. 6, 2008

(86) PCT No.: PCT/US2008/059519

§ 371 (c)(1),
(2), (4) Date: Sep. 16, 2010

(87) PCT Pub. No.: WO2009/126133

PCT Pub. Date: Oct. 15, 2009

(65) Prior Publication Data

US 2011/0012974 A1 Jan. 20, 2011

(51) Int. Cl.
*B41J 2/01* (2006.01)

(52) U.S. Cl.
USPC ..... 347/105; 347/101; 428/32.1

(58) Field of Classification Search
USPC ..... 347/100, 95, 96, 101, 88, 99, 102, 103, 347/105, 20, 21, 9; 106/31.6, 31.13, 31.27; 523/160, 161; 428/195, 32.1
See application file for complete search history.

(56) References Cited

U.S. PATENT DOCUMENTS

| | | | | |
|---|---|---|---|---|
| 6,025,068 | A | 2/2000 | Pekala | |
| 6,136,440 | A | 10/2000 | Ito et al. | |
| 6,531,231 | B1 * | 3/2003 | Ito et al. | 428/500 |
| 6,623,841 | B1 | 9/2003 | Venkatasanthanam et al. | |
| 6,800,342 | B2 | 10/2004 | Romano, Jr. et al. | |
| 6,857,737 | B2 | 2/2005 | Emslander et al. | |
| 6,878,423 | B2 | 4/2005 | Nakanishi | |
| 6,881,458 | B2 | 4/2005 | Ludwig et al. | |
| 7,086,732 | B2 * | 8/2006 | Kasperchik et al. | 347/105 |
| 2001/0015745 | A1 * | 8/2001 | Onishi et al. | 347/101 |
| 2003/0008114 | A1 * | 1/2003 | Nakanishi | 428/195 |
| 2003/0144446 | A1 | 7/2003 | Lee | |
| 2003/0180541 | A1 | 9/2003 | Naik et al. | |
| 2005/0176847 | A1 | 8/2005 | Cagle | |
| 2007/0084380 | A1 | 4/2007 | Cagle | |
| 2007/0216742 | A1 | 9/2007 | Sarkisian et al. | |
| 2007/0225401 | A1 | 9/2007 | Sarkisian et al. | |
| 2008/0081160 | A1 * | 4/2008 | Anderle et al. | 428/195.1 |
| 2009/0022910 | A1 * | 1/2009 | Teramae | 428/32.2 |
| 2009/0123675 | A1 * | 5/2009 | Shaw-Klein et al. | 347/105 |

FOREIGN PATENT DOCUMENTS

| | | | |
|---|---|---|---|
| KR | 19980019053 | A | 6/1998 |
| KR | 19980087137 | A | 12/1998 |
| KR | 19990066694 | A | 8/1999 |
| KR | 100374394 | B1 | 4/2003 |

OTHER PUBLICATIONS

International Search Report and Written Opinion for PCT/US2008/059519 dated Jan. 2, 2009 (12 pages).
International Preliminary Report on Patentability for PCT/US2008/059519 dated Oct. 21, 2010 (7 pages).
English Abstract of CN1392059A, Jan. 22, 2003, Daicei Chemical Ind Ltd (1 pg).
English Abstract of CN1142441A, Feb. 12, 1997, Togo Boseki (1 pg).

* cited by examiner

*Primary Examiner* — Manish S Shah

(57) ABSTRACT

The present disclosure relates to an inkjet printable article having an ink receiving layer bonded to a core substrate, the ink receiving layer including a blend of i) at least one self-crosslinkable polyurethane resin; ii) at least one self-crosslinkable styrene butadiene copolymer; and iii) at least one styrene acrylic copolymer, wherein the ink receiving layer is anionic or neutral, and wherein the core substrate includes a material selected from the group consisting of a woven material and a non-woven material.

25 Claims, No Drawings

INKJET PRINTABLE ARTICLE AND METHOD OF MAKING THE SAME

BACKGROUND

The present disclosure relates generally to woven and non-woven substrates. These substrates have been found to have poor printing quality and durability when printed with inks specifically developed for printing on vinyl and other similar organic materials. A primary issue with such substrates is the lack of a surface layer that can obtain good wetting when the ink hits the substrate. The result is generally low color gamut and undesirable color bleed. Furthermore, the printed area generally does not have good rubbing resistance.

DETAILED DESCRIPTION

Embodiment(s) of the article, method and system disclosed herein advantageously show that an optimized coating formulation including styrene acrylics, self-crosslinkable polyurethanes and self-crosslinkable styrene-butadiene copolymer significantly improves the color gamut (up to 500,000 color gamut can be achieved) and color bleed when the woven and non-woven substrates are printed with inks including pigment colorants, latex binder, non-aqueous solvent and water. The durability of the printed samples was also improved. In an embodiment, the ink printed onto the ink receiving layer of the inkjet printable article included a pigment colorant, a latex binder, non-aqueous solvent, and water.

In one embodiment of the inkjet printable article bonded to a core substrate, the ink receiving layer includes a blend of i) at least one self-crosslinkable polyurethane resin; ii) at least one self-crosslinkable styrene butadiene copolymer; and iii) at least one styrene acrylic copolymer. In a further embodiment, the ink receiving layer of the inkjet printable article includes 20-60 weight percent self-crosslinkable polyurethane resin; 10-40 weight percent self-crosslinkable styrene butadiene copolymer; and 10-50 weight percent styrene acrylic copolymer.

In yet another embodiment of the above-described ink printable article, the ink receiving layer of the inkjet printable article has a hardness range from about 5 MPa to about 50 MPa.

In an embodiment of the present disclosure, a combination of the following ingredients was used to achieve the coating formulation of the ink receiving layer for woven or non-woven substrates. Sancure® 815 and Turboset® 2025 are both self-crosslinkable polyurethanes obtained from Lubrizol in Cleveland, Ohio, USA. They were both used in this embodiment. These two polyurethanes together provided good rubbing resistance for the coating formulation in the rubbing test with Windex® cleaner. They also helped maintain good image quality. Rovene® 4151 is a self-crosslinkable styrene-butadiene copolymer obtained from Mallard Creek Polymer, Inc. in Charlotte, N.C., USA. This copolymer provided good affinity to an ink which included pigment colorant, latex binder, non-aqueous solvent and water. It also provided good image quality (IQ). Hycar® 26448 obtained from Lubrizol in Cleveland, Ohio, USA, is a styrene acrylic copolymer which was able to raise the surface energy of the ink receiving layer up to 45 dyne/cm from an original low level of 30 dyne/cm. This in turn helps to improve the color gamut.

Other known polyurethanes, such as Witcobond® 213 obtained from Chemtura Corp. in Middlebury, Conn., USA, AlberdingK® U2101 and AlberdingK® CUR 21 obtained from AlberdingK Boley Inc., in Greensboro, N.C., USA; Bayhydrol® 140AQ and Bayhydrol® XP 2618 obtained from Bayer Materialscience LLC. in Pittsburgh, Pa., USA, and Sancure® 2715 obtained from Lubrizol in Cleveland, Ohio, USA were tested in the ink receiving layer and were found to be not as effective except when extra cross-linker such as Xama® was added.

The ink receiving layer described above can be applied, as a non-limiting example, onto substrates made of woven or non-woven substrate material. Various methods can be used to apply the ink receiving layer to the substrate. Some non-limiting examples of such methods include gate-roll metering, blade metering, Meyer rod metering, or slot metering. A non-limiting example of the material used in the substrate made of woven or non-woven material includes high density polyethylene (HDPE).

In a non-limiting example of the woven substrate material, the HDPE begins as a mash and is extruded to produce HDPE fibers. The fibers are woven into a substrate. As an example, a substrate woven from HDPE fibers is available from PGI-Fabrene Inc. in Ontario, Canada, under product name PGI-Fabrene-V749-2W5W3. In still another embodiment, the woven substrate of the inkjet printable article can be in the form of woven or knit fabrics made from natural and/or synthetic fiber.

In a non-limiting example of the non-woven substrate material, the HDPE is pressed and set as a flat, sheet-like substrate material. An example of such a substrate is sold under the trade name Tyvek® obtained from DuPont in Wilmington, Del., USA.

Both woven and non-woven substrates have many voids or pores, each of which can be filled with an anionic or neutral particle having a diameter in the approximate range from 3 μm to 20 μm. Silica particles, which are anionic, are well suited for use in filling the pores which occur in such a substrate. Other inorganic or organic particles having an anionic or neutral charge can also be used. These include organic spheres which have a neutral charge.

Such particles used to fill pores or voids impart charge to the substrate itself. Thus a substrate with silica particles applied throughout the surface to fill the voids would have an overall negative surface charge. In contrast, a substrate with organic spheres used to fill the voids would have an overall neutral surface charge.

In an embodiment, as a result of the surface charge imparted by the anionic particles discussed above, the ink receiving layer of the inkjet printable article has a Zeta potential range from −10 to −80 mV. The values of Zeta potential were measured with Zetasizer Nano-ZS, model: Zen 3600 from Malvern Instruments in Westborough, MA, USA.

Also in an embodiment, it has been found that with inks printed on the above coating formulation, bleed occurs between the inks at less than 10 mils separation between the inks.

To further illustrate embodiment(s) of the present disclosure, the following examples are given herein. It is to be understood that these examples are provided for illustrative purposes and are not to be construed as limiting the scope of the disclosed embodiment(s).

EXAMPLES

Example 1

The Zeta potential was measured for various polymers including polyurethane and other polymers used in the ink receiving layer of the substrate described in the present application. The Zeta potential numbers are shown in Table 1. The Zeta potential value represents the ionic characteristics. A positive value represents cationic characteristics, and a negative value represents anionic characteristics.

TABLE 1

| Chemicals | Zeta potential (mV) |
|---|---|
| Sancure ® 815 | −33.9 |
| Turboset ® 2025 | −45.4 |
| Rovene ® 4151 | −49.1 |
| Hycar ® 26448 | −46.2 |

Example 2

Ink receiving layers Formulation 1 and Formulation 2 were prepared with the components shown in Table 2 with the weight concentrations given.

TABLE 2

| Chemicals | Formulation 1 | Formulation 2 |
|---|---|---|
| Sancure ® 815 | 40% | 36% |
| Turboset ® 2025 | 10% | 9% |
| Rovene ® 4151 | 20% | 18% |
| Hycar ® 26448 | 30% | 27% |
| Silica | | 10% |

The Zeta potential was measured for each of Formulations 1 and 2 as shown below in Table 3.

TABLE 3

| Chemicals | Zeta potential (mV) |
|---|---|
| Formulation 1 | −59.8 |
| Formulation 2 | −57.3 |

Example 3

A rubbing test with Windex® solvent was performed with various polyurethanes. A surface coated with the polyurethane is rubbed with a cloth soaked with Windex® solvent. The formulation is rated as pass/fail based on how well the surface remained intact in the face of the rubbing with Windex® solvent. "Pass" status was given to any test sample in which the film did not show any damage after the film was rubbed six times with Windex® cleaner. "Fail" status was given to any test sample in which the film showed damage after it was rubbed six times with Windex® cleaner. The results of the testing of various formulations are shown below in Table 4.

TABLE 4

| Ingredient | Rubbing test (pass/fail) |
|---|---|
| Witcobond ® W-213 | Fail |
| Witcobond ® W-296 | Fail |
| Sancure ® 2715 | Fail |
| Sancure ® 815 | Fail |
| Bayhydrol ® 140 AQ | Fail |
| Bayhydrol ® XP 2618 | Fail |
| AlberdingK ® Cur 21 | Fail |
| Turboset ® 2025 | Pass |

Example 4

Four formulations of urethanes and other polymers were applied as ink receiving layers to four substrates respectively. The formulations in the layers were designated Formulations 3 through 6. Non-aqueous solvent ink was then applied to each of the Formulations 3 through 6. Latex aqueous ink was also separately applied to each of the Formulations 3 through 6. The results are shown in Table 5 below. Only Formulation 6 showed good results with the non-aqueous solvent ink.

Formulations 3 through 6 were also tested for color-to-color bleed by printing two ink colors adjacent to each other. Bleed occurs when ink of one color travels over into the adjacent ink of the other color. The color-to-color bleed results shown in this application were measured in terms of the distance that one ink will travel over to bleed into the adjacent ink. The higher numbers in milli-inches (mil) in the color-to-color bleed results in Table 5 represent increased bleed. Such increased bleed results in worse image sharpness which affects image quality. When color to color bleed only occurs at a small distance between the inks, (e.g. <10 mil), this has a good effect on image sharpness and image quality.

TABLE 5

| | Ingredient | Weight % | Results | Color-to-Color Bleed |
|---|---|---|---|---|
| Formulation 3 | Sancure ® 815 | 80 | Poor film durability and poor color-to-color bleed with non-aqueous solvent ink | >25 mil |
| | Mowiol ® 40-88 | 20 | | |
| Formulation 4 | Sancure ® 815 | 80 | Poor film durability and poor performance with non-aqueous solvent ink | >30 mil |
| | Sancure ® 2725 | 20 | | |
| Formulation 5 | Sancure ® 815 | 80 | Poor film durability and poor color-to-color bleed, problem with tackiness with non-aqueous solvent ink | >25 mil |
| | PVP/VA S630 | 20 | | |
| Formulation 6 | Sancure ® 815 | 20 | Poor film durability, good print quality for | <10 mil |

TABLE 5-continued

| Ingredient | Weight % | Results | Color-to-Color Bleed |
|---|---|---|---|
| Turboset ® 2025 | 20 | both non-aqueous solvent ink and | |
| Rovene ® 4151 | 60 | aqueous ink with latex polymers | |

Example 5

Visual ratings of print quality were obtained for samples of Formulations 1-6 as described in the examples above. The samples were printed separately with non-aqueous solvent ink and aqueous ink with latex polymers. In the rating, 1 is the worst, and 5 is the best. The ratings are tabulated below in Table 6. The table also includes results of film durability tests described in Example 3 based on the rubbing test with Windex® cleaner as solvent. Tests were performed on both non-woven and woven substrates.

TABLE 6

Performance Summary

| Formulation | Film Durability | Print Quality with HP Latex Aqueous Ink | Print Quality with HP Solvent Ink |
|---|---|---|---|
| 1 | Pass | 4 | 4 |
| 2 | Pass | 5 | 5 |
| 3 | Fail | 2.5 | 2 |
| 4 | Fail | 2.5 | 2 |
| 5 | Fail | 2 | 3 |
| 6 | Fail | 4 | 5 |

Example 6

Formulation 2 was applied as an ink receiving layer on both Tyvek® substrate and HPDE woven film. The hardness of the ink receiving layer was measured in MPa for each substrate. Results of the hardness measurements are listed in Table 7. The film hardness data presented in this example were measured with MTS Nanoindenter XP with a Berkovich tip.

TABLE 7

Hardness Test Results

| Formulation | Substrate | Hardness (MPa) |
|---|---|---|
| 2 | Tyvek ® | 26 |
| 2 | HDPE woven film | 35 |

While several embodiments have been described in detail, it will be apparent to those skilled in the art that the disclosed embodiments may be modified. Therefore, the foregoing description is to be considered exemplary rather than limiting.

What is claimed is:

1. An inkjet printable article comprising an ink receiving layer bonded to a core substrate, the ink receiving layer including a blend of i) at least one self-crosslinkable polyurethane resin; ii) at least one self-crosslinkable styrene butadiene copolymer; and iii) at least one styrene acrylic copolymer, wherein the ink receiving layer is anionic or neutral, and wherein the core substrate includes a material selected from the group consisting of a woven material and a non-woven material.

2. The article of claim 1 wherein the ink receiving layer consists essentially of:

about 20-60 weight percent self-crosslinkable polyurethane resin;

about 10-40 weight percent self-crosslinkable styrene butadiene copolymer; and about 10-50 weight percent styrene acrylic copolymer.

3. The article of claim 1 wherein a surface of the core substrate includes inorganic or organic particles, the particles having a diameter from about 3 μm to about 20 μm and having an anionic or neutral charge;

and wherein the core substrate surface particles are selected from the group consisting of silica particles, organic plastic spherical particles, and combinations thereof.

4. The article of claim 1 wherein the ink receiving layer has a Zeta potential range from −10 mV to −80 mV.

5. The article of claim 1 wherein the ink receiving layer has a hardness range from 5 MPa to 50 MPa.

6. The article of claim 1 wherein the woven material or the non-woven material includes polymers.

7. The article of claim 6 wherein the polymers include high density polyethylene (HDPE).

8. The article of claim 1 wherein the woven material includes high density polyethylene (HDPE) fibers.

9. The article of claim 1 wherein the woven material is a fabric.

10. The article of claim 1 wherein bleed is at less than 10 mil separation between two inks printed on the inkjet printable article.

11. The article of claim 1 wherein the ink printed onto the ink receiving layer includes a pigment colorant, a latex binder, non-aqueous solvent, and water.

12. A method of producing an inkjet printable article including a core substrate and an ink receiving layer, the method comprising the step of applying onto a core substrate surface a coating composition including:

at least one self-crosslinkable polyurethane resin;

at least one self-crosslinkable styrene butadiene copolymer; and at least one styrene acrylic polymer;

wherein the core substrate includes a material selected from the group consisting of a woven material and a non-woven material.

13. The method of claim 12 wherein the ink receiving layer consists essentially of:

about 20-60 weight percent self-crosslinkable polyurethane resin;

about 10-40 weight percent self-crosslinkable styrene butadiene copolymer; and about 10-50 weight percent styrene acrylic copolymer.

14. The method of claim 12 wherein the core substrate surface includes inorganic or organic particles, the particles having a diameter from 3 to 20 μm and having an anionic or neutral charge; and wherein the core substrate surface particles are selected from the group consisting of silica particles and organic plastic spherical particles and combinations thereof.

15. The method of claim 12 wherein the ink receiving layer has a Zeta potential range from −10 mV to −80 mV.

16. The method of claim 12 wherein the ink receiving layer has a hardness range from 5 MPa to 50 MPa.

17. The method of claim 12 wherein the ink printed onto the ink receiving layer includes a pigment colorant, a latex binder, non-aqueous solvent and water.

18. The method of claim 12 wherein bleed is at less than 10 mil separation between two inks printed on the ink receiving layer.

19. A system of inkjet printing with a core substrate having an ink receiving layer, comprising:

an inkjet printer;

the ink receiving layer including i) at least one self-crosslinkable polyurethane resin; ii) at least one self-crosslinkable styrene butadiene copolymer; and iii) at least one styrene acrylic polymer; and the core substrate including a material selected from the group consisting of a woven material and a non-woven material.

20. The system of claim 19 wherein the ink receiving layer consists essentially of 20-60 weight percent self-crosslinkable polyurethane resin; 10-40 weight percent self-crosslinkable styrene butadiene copolymer; and 10-50 weight percent styrene acrylic copolymer.

21. The system of claim 19 wherein a surface of the core substrate includes inorganic or organic particles, the particles having a diameter from 3 to 20 μm and having an anionic or neutral charge; and wherein the core substrate surface particles are selected from the group consisting of silica particles and organic plastic spherical particles and combinations thereof.

22. The system of claim 19 wherein the ink receiving layer has a Zeta potential range from −10 to −80 mV.

23. The system of claim 19 wherein the ink receiving layer has a hardness range from 5 MPa to 50 MPa.

24. The system of claim 19 wherein the ink printed onto the ink receiving layer includes a pigment colorant, a latex binder, a non-aqueous solvent and water.

25. The system of claim 19 wherein bleed is at less than 10 mil separation between two inks printed on the ink receiving layer.

* * * * *